US007065798B2

(12) United States Patent
Kuo

(10) Patent No.: US 7,065,798 B2
(45) Date of Patent: Jun. 27, 2006

(54) HELMET SHIELD PROVIDED WITH POSITIONING AND ADJUSTING DEVICE

(75) Inventor: Chao-Yen Kuo, Tainan (TW)

(73) Assignee: Kin Yong Lung Industrial Co., Ltd., Tainan (TW)

( * ) Notice: Subject to any disclaimer, the term of this patent is extended or adjusted under 35 U.S.C. 154(b) by 0 days.

(21) Appl. No.: 10/989,326

(22) Filed: Nov. 17, 2004

(65) Prior Publication Data

US 2006/0101561 A1 May 18, 2006

(51) Int. Cl.
*A42B 1/08* (2006.01)

(52) U.S. Cl. ..... 2/424

(58) Field of Classification Search ..... 2/424, 2/6.3, 6.5

See application file for complete search history.

(56) References Cited

U.S. PATENT DOCUMENTS 4,794,652 A * 1/1989 Piech von Planta et al. .... 2/414
5,461,731 A * 10/1995 Shida ..... 2/424
6,622,314 B1 * 9/2003 Kim et al. ..... 2/424
6,654,969 B1 * 12/2003 Taniuchi ..... 2/424
6,732,380 B1 * 5/2004 Lee ..... 2/424
6,842,913 B1 * 1/2005 Song ..... 2/424

* cited by examiner

*Primary Examiner*—Rodney M. Lindsey
(74) *Attorney, Agent, or Firm*—Rosenberg, Klein & Lee

(57) ABSTRACT

The helmet shield is provided with a buckling annulus at the inner side of each end portion, spaced catching blocks are provided around each buckling annulus, each catching block is provided with a slant surface, and a protruding rod is provided below each buckling annulus. A pair of fixing pieces are respectively provided to secure to both end portions of the helmet shield. Each fixing piece is provided with an annular catching groove, each annular catching groove is provided with a plurality of hollows and an opening, each hollow is provided with a stopping wall at one side, and the hollows and the opening of each annular catching groove are provided for a buckling member to be assembled. An arc notched portion and an arc sliding groove are provided below each annular catching groove.

2 Claims, 9 Drawing Sheets

HELMET SHIELD PROVIDED WITH POSITIONING AND ADJUSTING DEVICE

BACKGROUND OF THE INVENTION

1. Field of the Invention

The present invention relates to a helmet shield provided with positioning and adjusting device, and more particularly to a helmet shield whose catching blocks can effectively function and prevent from being broken and falling off after being used to adjust the helmet shield for a period of time, so as to prolong the service life of the helmet shield.

2. Description of the Related Art

A conventional helmet shield provided with positioning and adjusting device includes a helmet body 5, a pair of fixing pieces 6 and a helmet shield 7, as shown in FIG. 1.

While being assembled, referring to FIGS. 1 and 2, the pair of fixing pieces 6 are respectively secured to the left and right inner sides of the helmet body 5 by screwing the screws N into the screwing holes 61, then each annular flange 71 on each inner end side of the helmet shield 7 is sleeved in each flanged annulus 62 of each fixing piece 6 to make each catching block 72 of the shield be against on each retaining member 63 of each flanged annulus 62, and each arc notched block 73 and each notched flange 641 of each inner arc board 64 are engaged.

When the helmet shield 7 being operated to move upward or downward, each catching block 72 being against on each retaining member 63 will accordingly slide upward or downward, each arc notched block 73 engaged with each notched flange 641 will slide to a fixed position, and each sliding block 74 below each arc notched block 73 will slide in the sliding groove accordingly. When the helmet shield 7 being moved upward to a certain height, each sliding block 74 will be stopped by the post 651 of each stopping block 65, as shown in FIG. 3, so as to prevent the helmet shield 7 from being separated from the helmet body 5 by strong force.

However, because each catching block 72 is designed to be L-shaped, each catching block 72 is easily broken or falls off, and the helmet shield 7 will lose the function of positioning and adjusting if the helmet body 5 is struck by external force or the helmet shield 7 is moved by excessive force.

SUMMARY OF THE INVENTION

Therefore, the present invention provides a helmet shield provided with positioning and adjusting device that substantially obviates the drawbacks of the prior art.

An object of the present invention is to provide a helmet shield whose catching blocks can effectively function and prevent from being broken and falling off after being used for a period of time and can prolong the service life of the helmet shield.

To realize these advantages, the present invention provides a helmet shield with positioning and adjusting device. The helmet shield is provided with a buckling annulus at the inner side of each end portion, spaced catching blocks are provided around each buckling annulus, each catching block is provided with a slant surface, and a protruding rod is provided below each buckling annulus. A pair of fixing pieces are respectively provided to secure to both end portions of the helmet shield. Each fixing piece is provided with an annular catching groove at the inner side, each annular catching groove is provided with a plurality of hollows and an opening, each hollow is provided with a stopping wall at one side, and the hollows and the opening of each annular catching groove are provided for a buckling member to be assembled. An arc notched portion and an arc sliding groove are provided below each annular catching groove.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
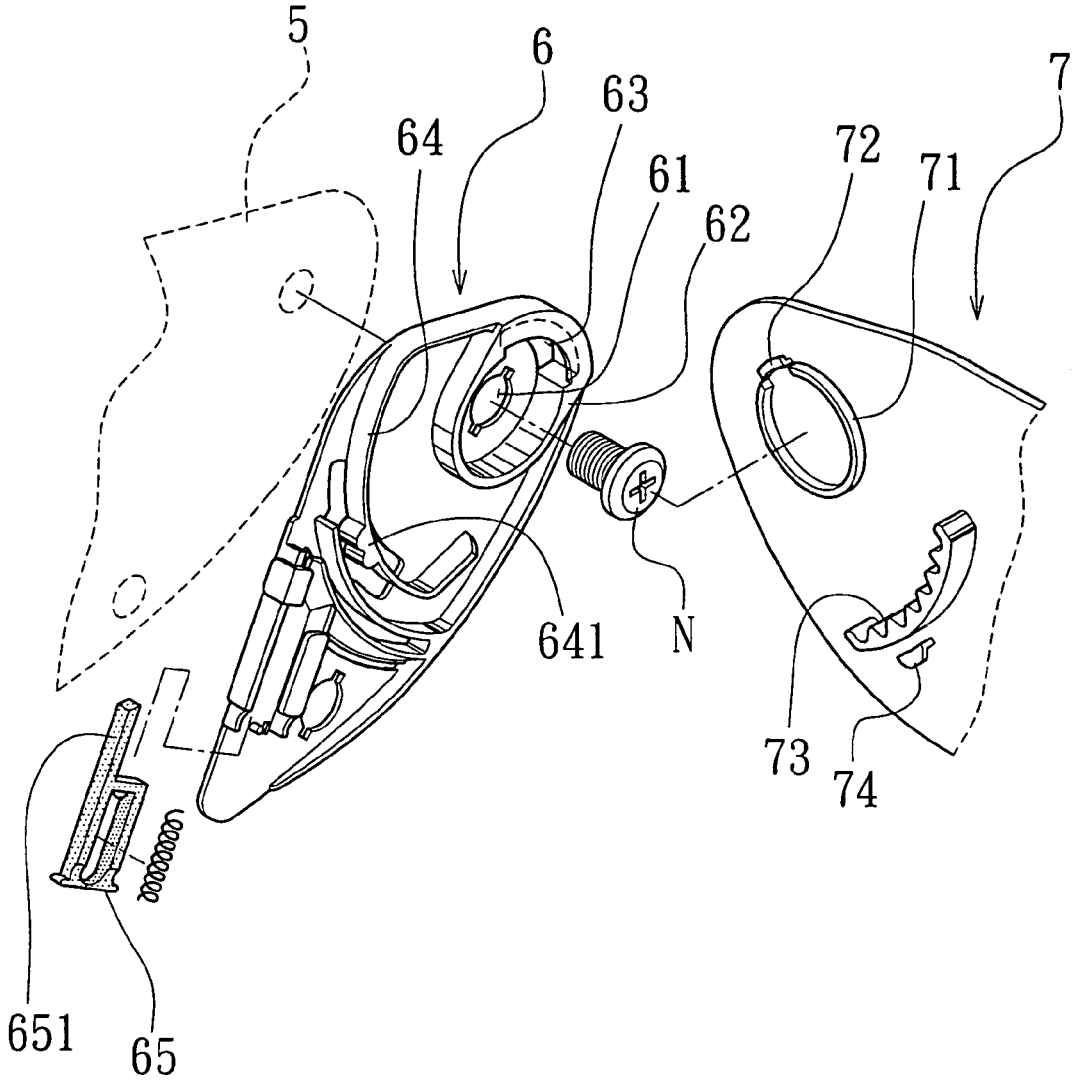
FIG. 1 (PRIOR ART)
FIG. 1 is a perspective exploded view of a conventional helmet shield and positional and adjusting device.
Figure 2:
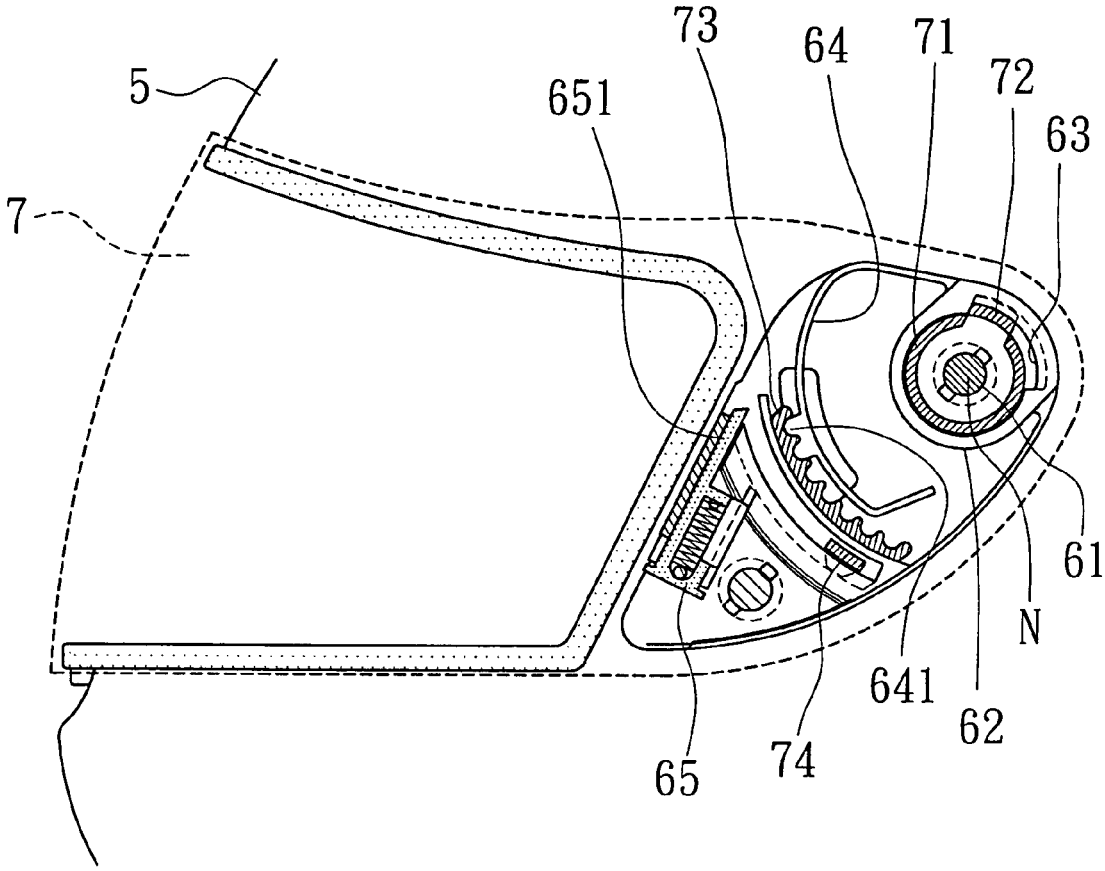
FIG. 2 (PRIOR ART)
FIG. 2 is a sectional view of a conventional helmet shield and positional and adjusting device in an assembled configuration.
Figure 3:
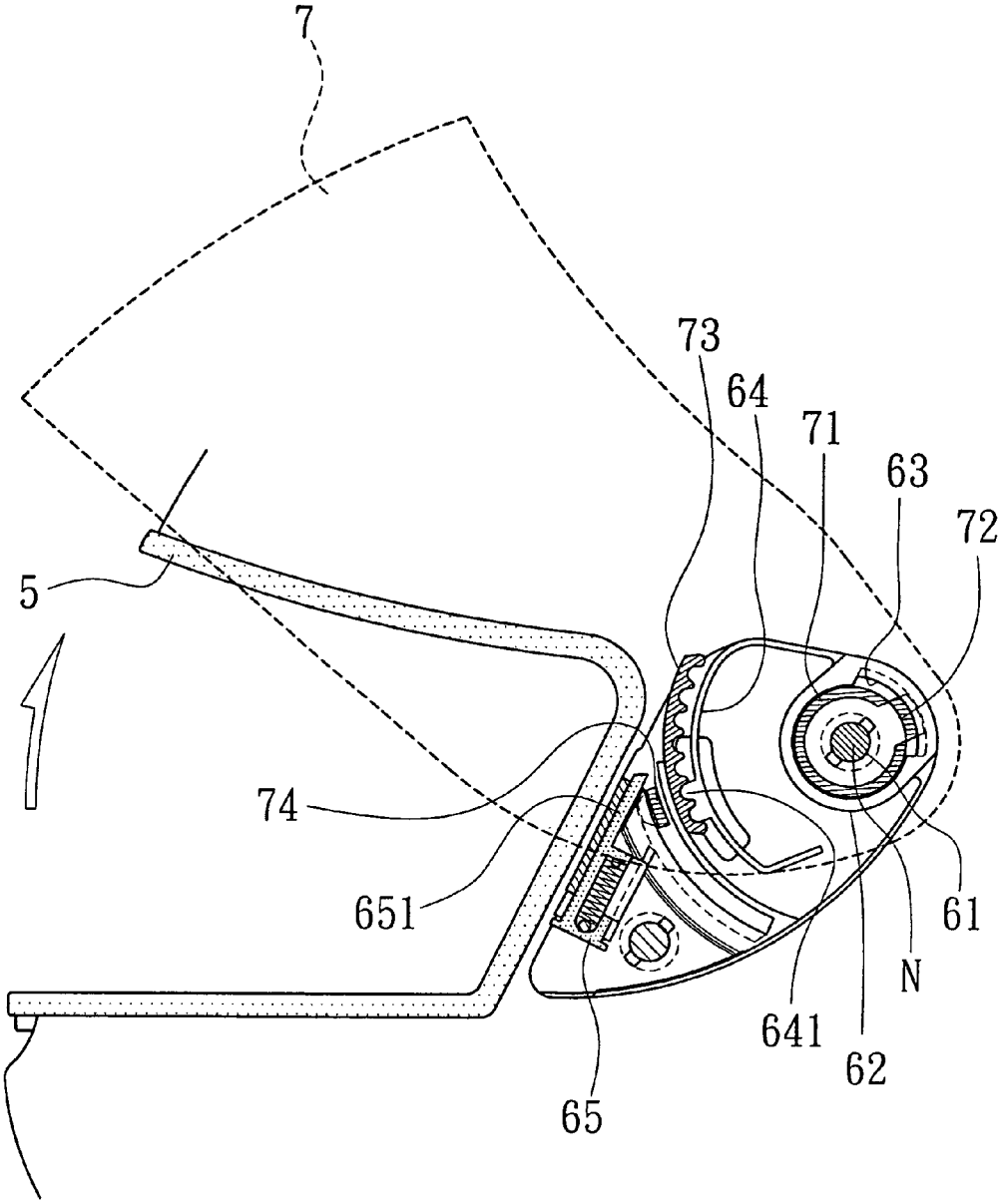
FIG. 3 (PRIOR ART)
FIG. 3 is a schematic sectional view of a conventional helmet shield with positional and adjusting device in its activated configuration for use.
Figure 4:
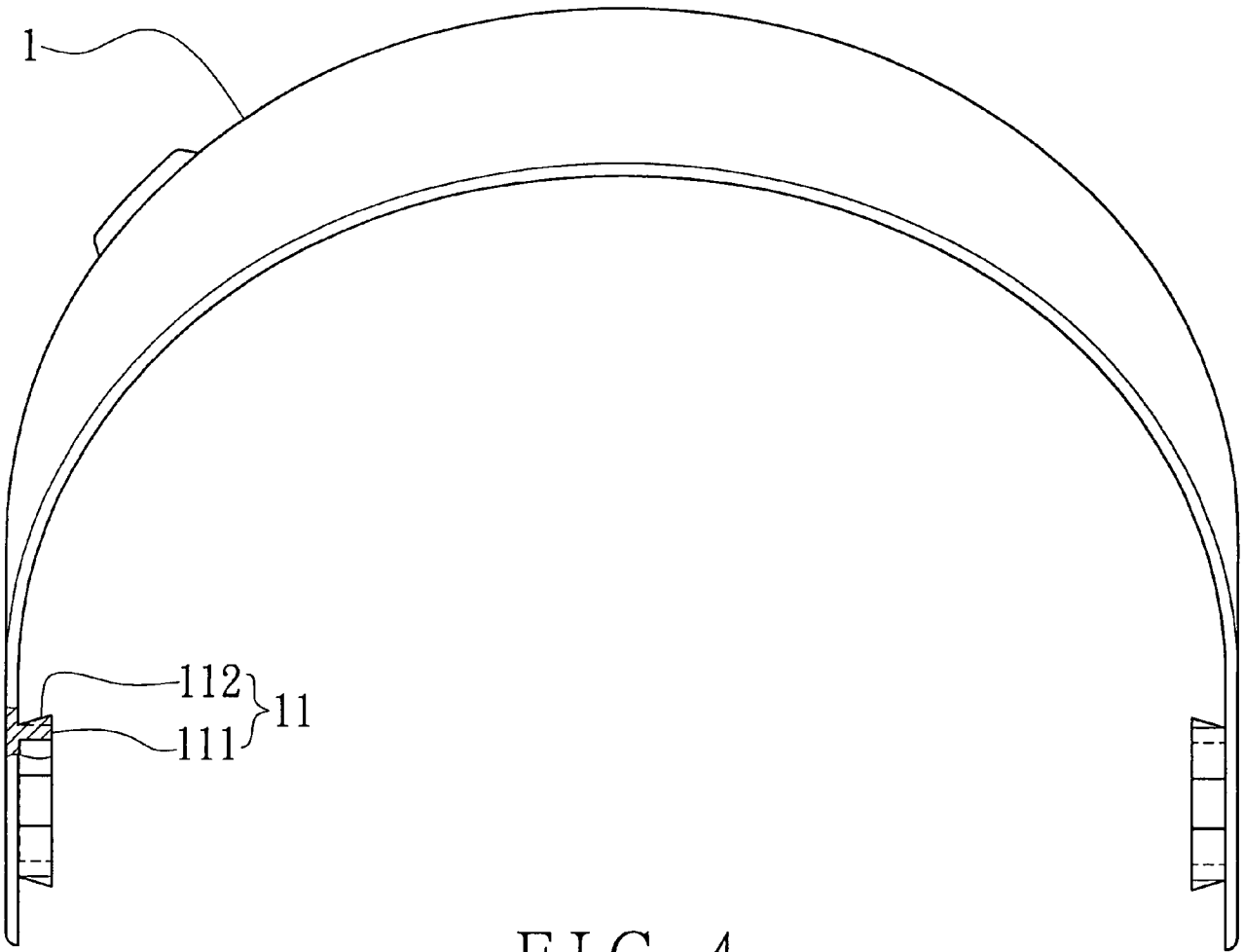
FIG. 4 is a top view of an embodiment of the helmet shield with positional and adjusting device in an assembled configuration in accordance with the present invention.
Figure 5:
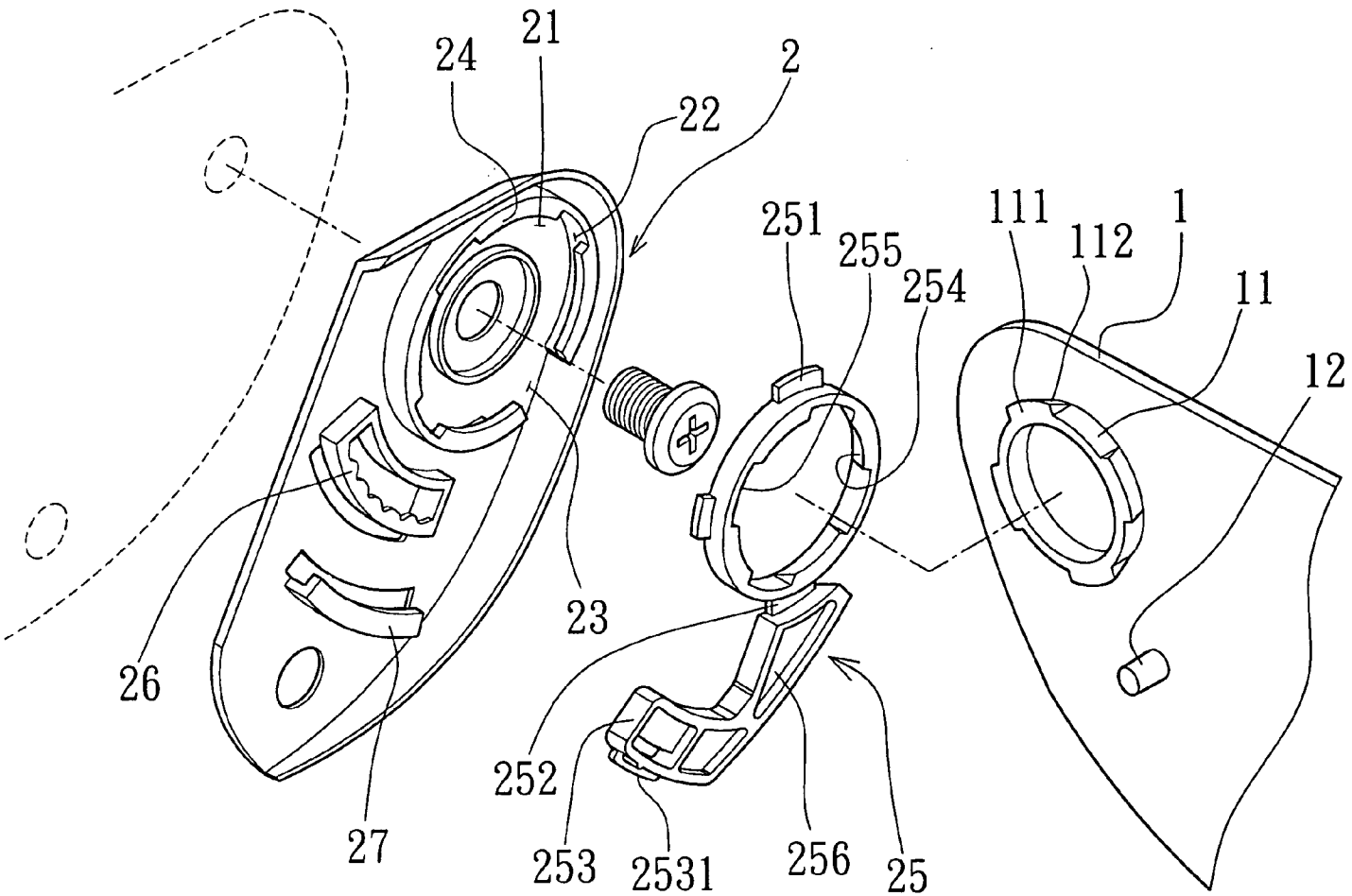
FIG. 5 is a perspective exploded view of an embodiment of the helmet shield and positional and adjusting device in accordance with the present invention.

Referring to FIGS. 4 and 5, the helmet shield 1 in the present invention is provided with positoning and adjusting device, and the positoning and adjusting device includes a pair of fixing pieces 2 being respectively provided to secure to both end portions of the helmet shield 1.

The helmet shield 1 is provided with a buckling annulus 11 at the inner side of each end portion, spaced catching blocks 111 are provided around each buckling annulus 11, each catching block 111 is provided with a slant surface 112, the best slope of each slant surface 112 is 45 degrees, and a protruding rod 12 is provided below each buckling annulus 11.

Each fixing piece 2 is provided with an annular catching groove 21 at the inner side, each annular catching groove 21 is provided with a plurality of hollows 22 and an opening 23, each hollow 22 is provided with a stopping wall 24 at one side, and the hollows 22 and the opening 23 of each annular catching groove 21 are provided for a buckling member 25 to be assembled. An arc notched portion 26 and an arc sliding groove 27 are provided below each annular catching groove 21.

Figure 6:
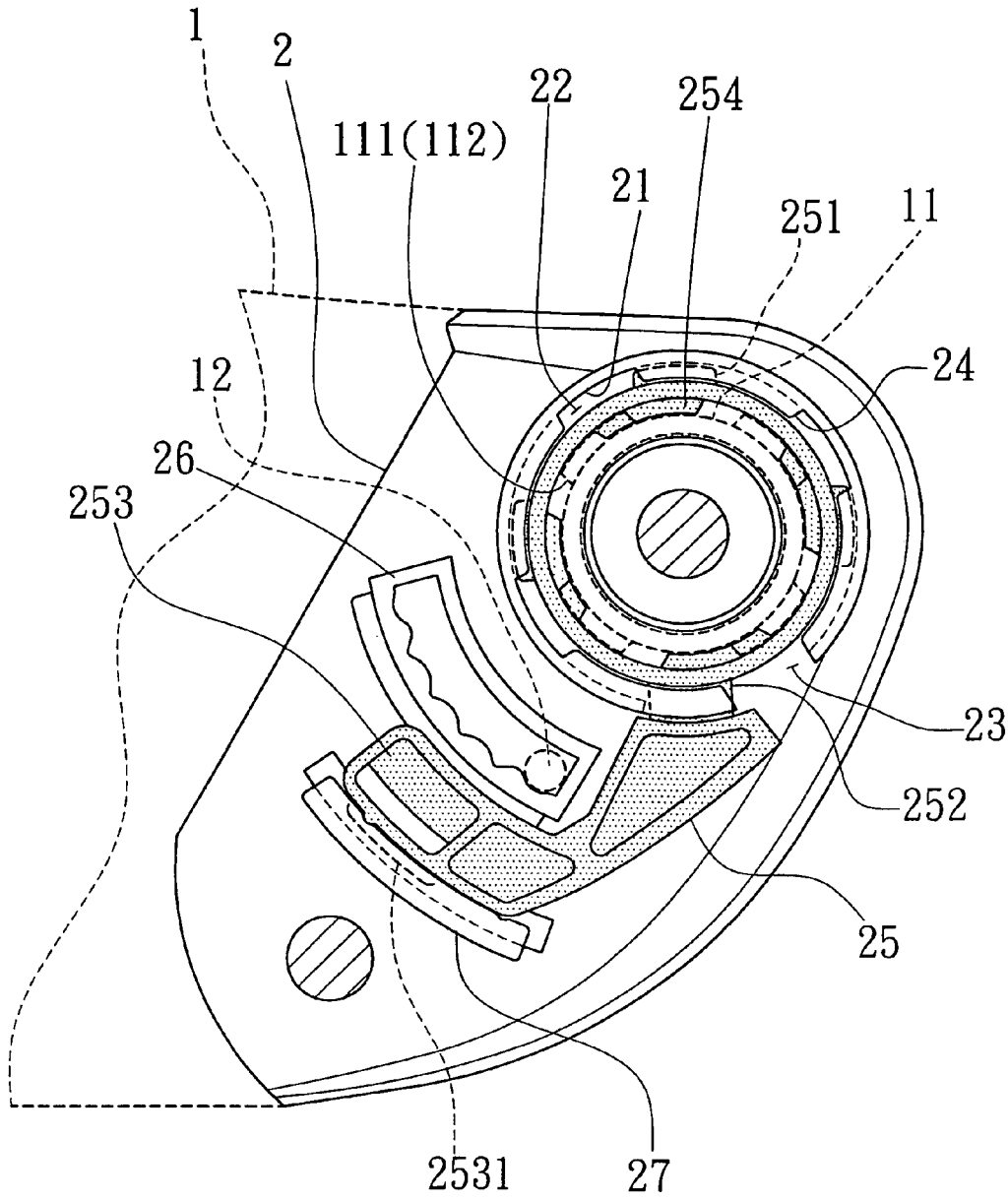
FIG. 6 is a sectional view of the helmet shield and the fixing piece in an assembled configuration in accordance with the present invention.

Referring to FIG. 6, while being assembled, the head portion of the buckling member 25 is inserted into the annular catching groove 21 to make the flanges 251 provided around the head portion of the buckling member 25 be respectively inlaid in the hollows 22 of the annular catching groove 21 able to move in the interior of the stopping walls 24, the neck portion 252 is inserted in the opening 23 of the annular catching groove 21 able to move in the interior of the stopping walls 24, and the against article 2531 of the tail portion 253 is inlaid in the arc sliding groove 27 for each buckling member 25 to be firmly secured to each fixing piece 2. Then, each fixing piece 2 as well as each buckling member 25 is firmly assembled with the helmet shield 1 by means of each catching block 111 around each buckling annulus 11 of the helmet shield 1 to be inlaid in each hollow 255 of each buckling member 25, and each protruding rod 12 is inserted in each arc notched portion 26 at the same time.

Figure 7:
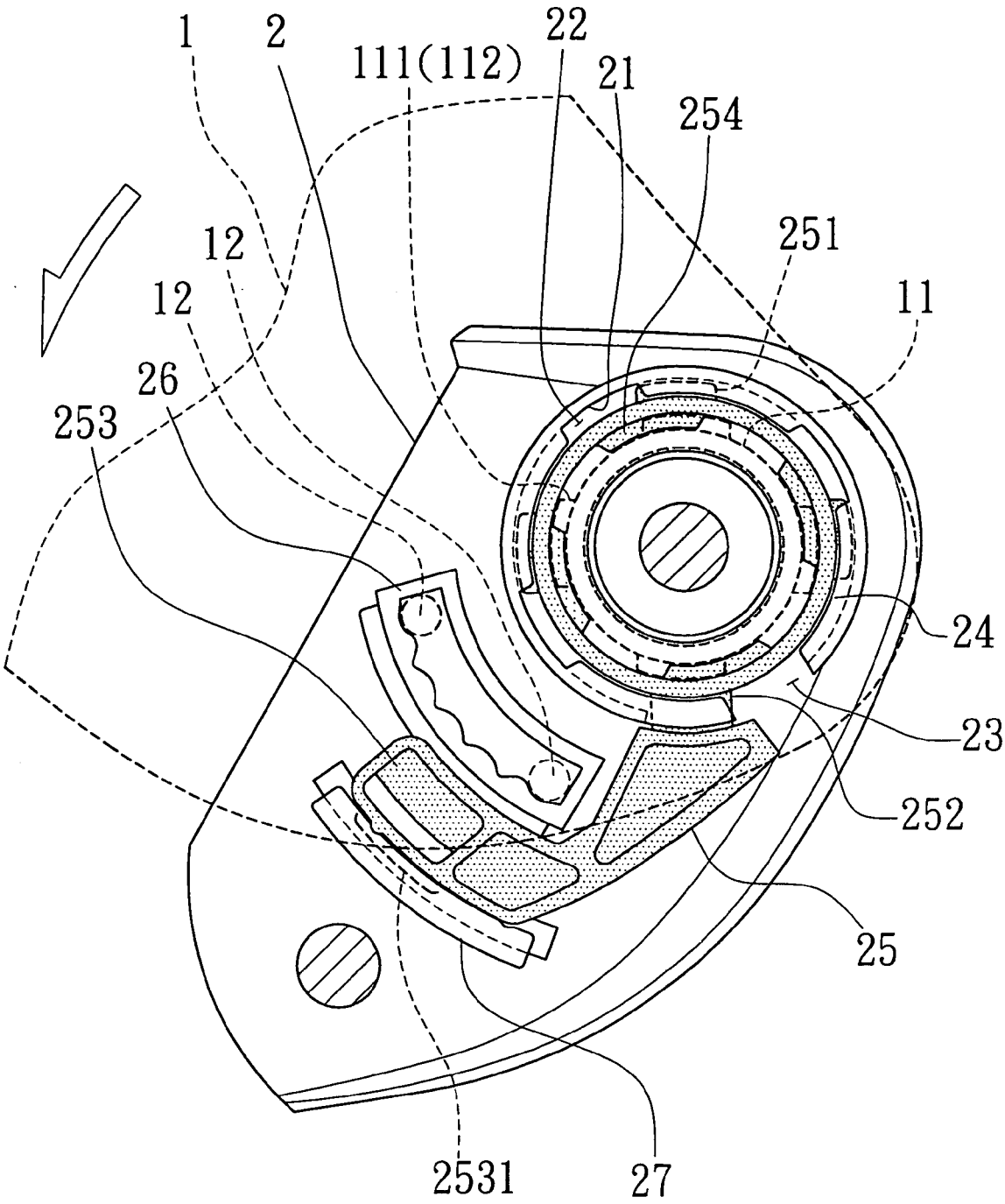
FIG. 7 is a schematic view of the catching blocks sliding in the buckling member when the helmet shield moving downward in accordance with the present invention.

Referring to FIG. 7, while being activated to use, the helmet shield 1 is moved downward, each buckling annulus 11 as well as each catching block 111 in each buckling member 25 will turn downward accordingly to make each slant surface 112 of each catching block 111 smoothly slide over each slant surface 254 of each buckling member 25, and each protruding rod 12 will slide downward in each arc notched portion 26.

Figure 8:
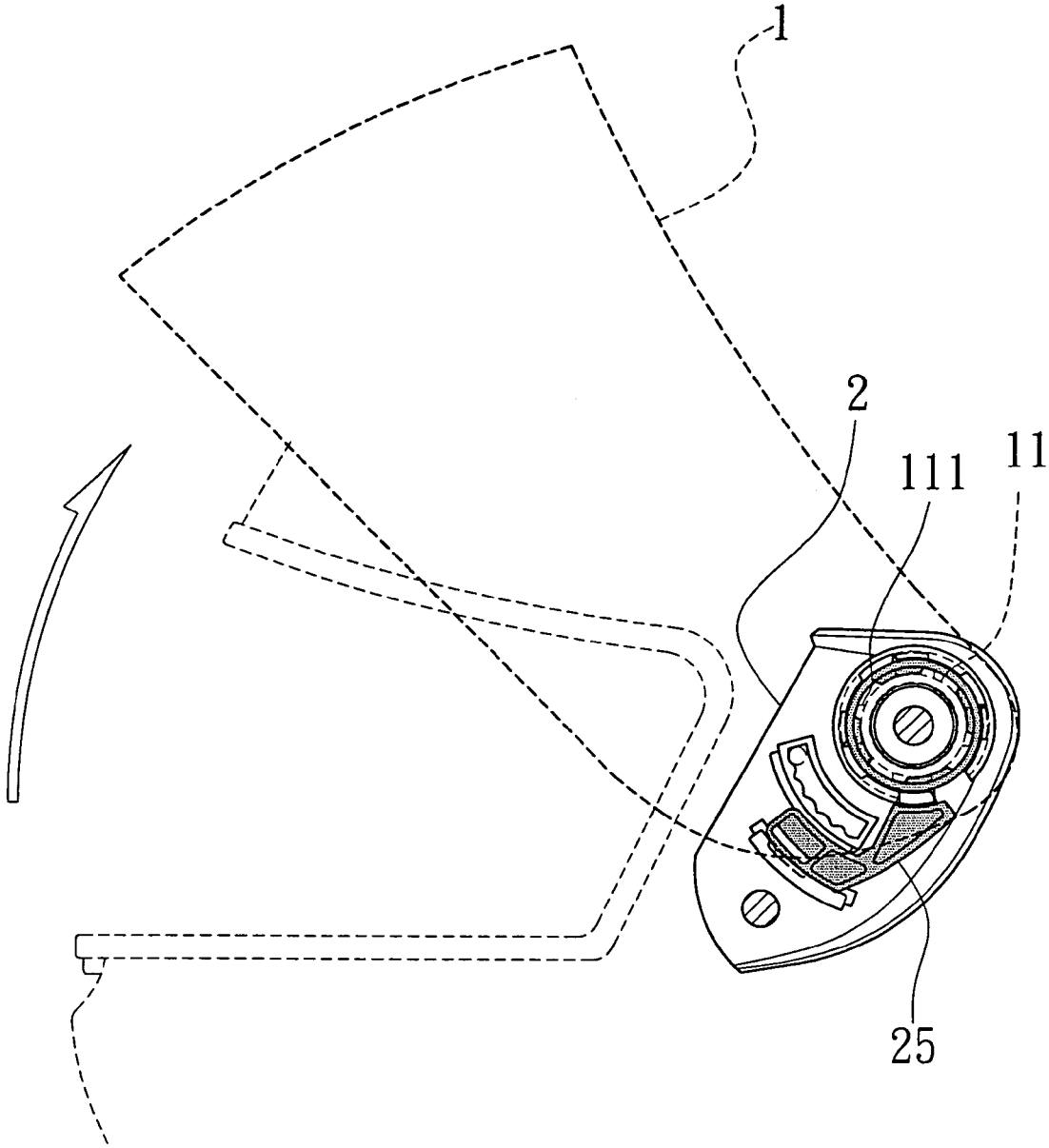
FIG. 8 is a schematic view of the catching blocks sliding in the buckling member when the helmet shield moving upward in accordance with the present invention; and, FIG. 9 is a schematic view showing the fixing piece separating from the buckling member in accordance with the present invention.

Reversely, when the helmet shield 1 is moved upward, each buckling annulus 11 as well as each catching block 111 in each buckling member 25 will turn upward accordingly to make each slant surface 112 of each catching block 111 smoothly slide over each slant surface 254 of each buckling member 25, and each protruding rod 12 will slide upward in each arc notched portion 26, as shown in FIG. 8.

Figure 9:
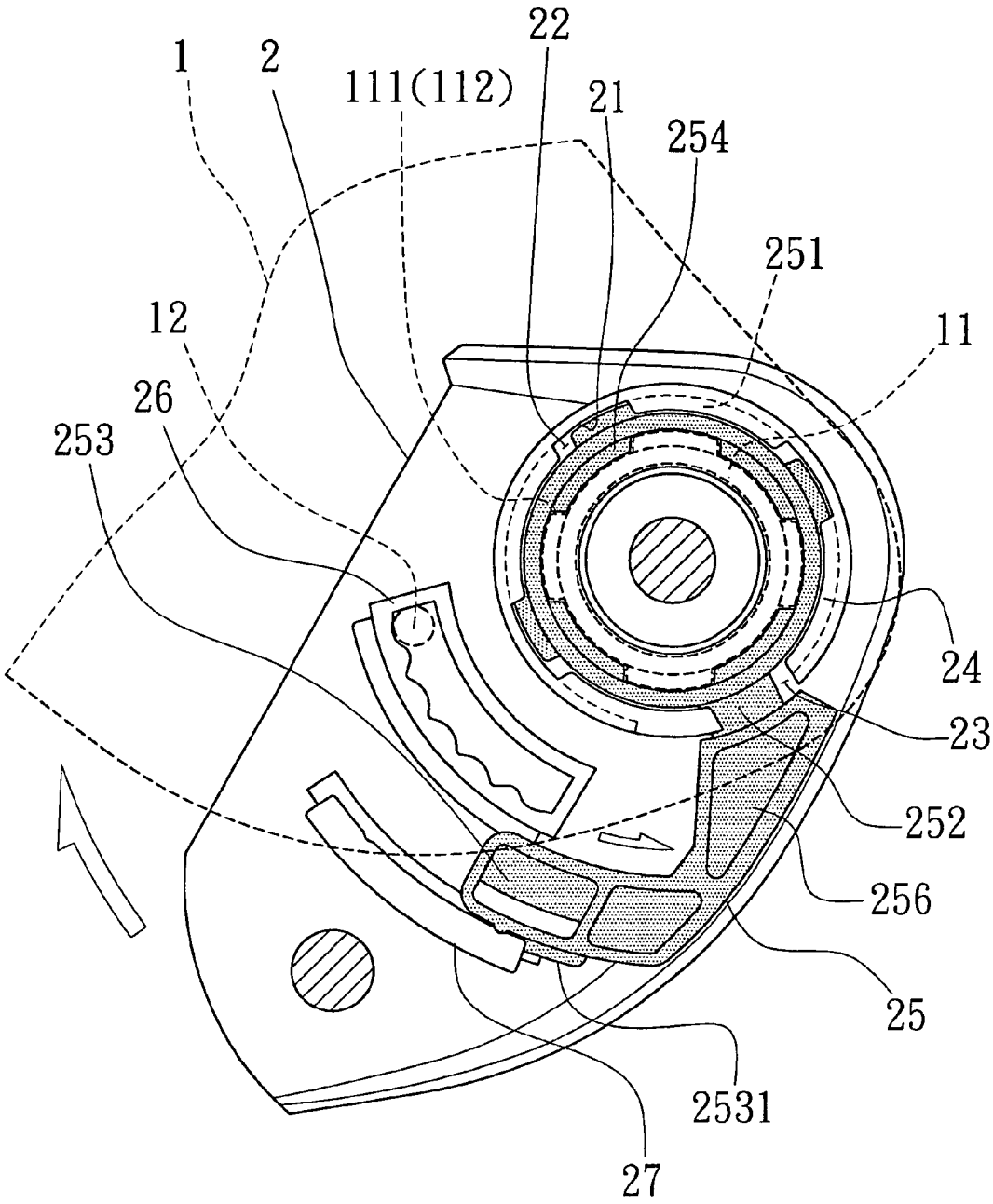

Referring to FIG. 9, if the helmet shield 1 is necessary to be replaced, the pushing portion 256 of each buckling member 25 is pushed outward to make each flange 251 of each buckling member 25 register with each hollow 22 of each fixing piece 2 and the neck portion 252 of each buckling member 25 register with the opening 23 of each fixing piece 2, so as to let each fixing piece 2 separate from each buckling member 25.

While the preferred embodiments of the invention have been described above, it will be recognized and understood that various modifications may be made therein and the appended claims are intended to cover all such modifications which may fall within the spirit and scope of the invention.

What is claimed is:

1. A helmet shield provided with a positioning and adjusting device comprising:

two buckling annuluses respectively extending from inner sides of each of two end portions of said helmet shield, each buckling annulus having a plurality of catching blocks formed around a periphery of said buckling annulus, each catching block being formed with a first slanted surface extending from a distal end of said buckling annulus toward said helmet shield; and a pair of buckling members respectively coupled to opposing sides of the helmet and extending therefrom for respective rotative engagement with said buckling annuluses, each of said buckling members having a plurality of block members formed around a periphery of said buckling member, each block member being formed with a second slanted surface extending from a distal end of said buckling member toward said helmet, said second slanted surface being complementary to said first slanted surface and said first slanted surfaces of said catch blocks being slidingly engaged with corresponding second slanted surfaces of said block member.

2. The positioning and adjusting device for a helmet shield as claimed in claim 1, wherein each of said first and second slanted surfaces are at an angle of 45 degrees.

* * * * *